US007883350B2

(12) United States Patent
Byrnes et al.

(10) Patent No.: US 7,883,350 B2
(45) Date of Patent: Feb. 8, 2011

(54) HEADER CONNECTORS WITH RIGID LATCHES

(75) Inventors: Derek Byrnes, Shannon (IE); Desmond Ryan, Ennis (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/432,159

(22) Filed: Apr. 29, 2009

(65) Prior Publication Data

US 2010/0279534 A1 Nov. 4, 2010

(51) Int. Cl.
*H01R 13/62* (2006.01)

(52) U.S. Cl. ..... 439/329; 439/157; 439/358

(58) Field of Classification Search ..... 439/329, 439/374, 358, 157, 405, 328, 494
See application file for complete search history.

(56) References Cited

U.S. PATENT DOCUMENTS 3,993,390 A 11/1976 Eigenbrode
4,241,966 A * 12/1980 Gomez ..... 439/157
4,410,222 A * 10/1983 Enomoto et al. ..... 439/157
4,579,408 A * 4/1986 Sasaki ..... 439/153
4,582,378 A * 4/1986 Fruchard ..... 439/157
5,037,323 A 8/1991 Locati
5,112,242 A * 5/1992 Choy et al. ..... 439/326
5,413,497 A * 5/1995 Lwee ..... 439/328
5,468,156 A 11/1995 Flinchbaugh et al.
5,571,025 A * 11/1996 Arai et al. ..... 439/160
5,921,812 A * 7/1999 Choy ..... 439/567
6,033,267 A 3/2000 Smyk
6,048,222 A 4/2000 Price
6,179,642 B1 1/2001 Hwang
6,817,887 B2 * 11/2004 Jones et al. ..... 439/405
7,578,689 B2 * 8/2009 Guan et al. ..... 439/327
7,658,628 B2 * 2/2010 Guan et al. ..... 439/157

* cited by examiner

*Primary Examiner*—Hae Moon Hyeon
(74) *Attorney, Agent, or Firm*—Larry I. Golden

(57) ABSTRACT

This approach generally pertains to a header connector with rigid latches. The connector includes columns with column cavities therein and latching mechanisms having latch beams and latching ends, with a plurality of mating contacts with mounting pins affixed to a dielectric housing. A harness is securable to the header connector generally between the latching mechanisms. The harness is insertable and removable. The harness provides easy access to a tool that can facilitate extraction of the harness from the header connector.

8 Claims, 6 Drawing Sheets

HEADER CONNECTORS WITH RIGID LATCHES

BACKGROUND OF THE INVENTION

This present invention generally pertains to high density connectors and more particularly to high density headers and harnesses with rigid latched connection. The connectors can be suitable for automotive or vehicle applications or for use in other industries utilizing electronic components.

DESCRIPTION OF BACKGROUND ART

High density header connectors that suitably mount to printed circuit boards are used in diverse applications such as automobile and vehicle audio and video equipment including car radios, receivers and players, and non-vehicle receivers and players, VCRs, CD and DVD players and recorders, televisions, computer peripherals and telecommunications. Typically these headers have low profiles. Connectors having vertical mating configurations with one-piece upper housing construction provide reliability and good cable retention and are suited for small circuit size applications. Despite good retention, breaks in connection can occur. For example, the connection between a header and a harness when the harness is being pushed and pulled in an assembly process can result in unintended unmating of the male and female connectors.

Prior art approaches that have not recognized the positives that could be gained by seeking to achieve the objectives or teach solutions as those of the present approach include U.S. Pat. No. 3,993,390, which pertains to a molded header with cavities at each end to receive separately molded latches. The separately molded latches have protruding members that are inserted into the cavities of the header and are held in place with interference fit. A variety of separately molded latches overcome issues in limited applications. The molded latches depicted in this patent, however, have unprotected latch release members subject to accidental release or damage. U.S. Pat. No. 5,037,323 relates to an electrical connector with blind mate shrouds that are attached to the ends of the electrical connector. The shroud assists in aligning a complementary connector during mating of the two connectors as well as maintaining alignment of the two connectors during unmating of the two connectors. U.S. Pat. No. 5,468,156 relates to a system for locking a daughterboard in the header of a motherboard without involving the daughterboard connector. The motherboard header contains separately molded latches at each end. The latches have a pivoting boss and a detent to hold the latch in an open position. Furthermore, the latches have an upper exposed portion with an unprotected actuating section for opening and closing the latch. The unprotected actuating section subjects the latch to accidental release.

Other prior art includes the following. U.S. Pat. No. 6,033,267 relates to connectors having insulating material extending partially across contact windows such that retention force is applied to header pins when they are inserted into the windows. Mating and un-mating forces remain uniform after numerous mating and un-mating cycles. Latches, furthermore, are pivotally mounted to the ends of the header and the tops of the latches have unprotected release extensions. U.S. Pat. No. 6,048,222 pertains to ribbon cable connectors that have integral, flexible and unprotected latches at the ends of the ribbon cable connectors. The ribbon cable connectors are mounted to hardware devices such as male headers. The flexible latches engage notches in the male headers and are released with digital pressure applied to the side of the flexible latches. U.S. Pat. No. 6,179,642 relates to a connector assembly comprising a first connector, a second connector and a strain relief device for releasably attaching the second connector to the first connector. The strain relief device includes outer unprotected integral latches at each end that engage a connector header.

With the present approach, it has been determined that various characteristics of prior art, such as these patents, have shortcomings and undesirable attributes, results and/or effects. The present approach recognizes and addresses matters such as these to provide enhancements not heretofore available. Overall, the present approach provides a more fully enhanced retention force of mated connectors.

More specifically, goals that have been arrived at in accordance with the present approach, while maintaining good manufacturing control and minimizing variation of tolerance, include increasing the retention force and protecting the connector such that the increased retention force is maintained during the assembly process. Other goals include ease of extraction of a mated harness and low manufacturing costs with high reliability in performance.

SUMMARY OF THE INVENTION

An embodiment of the present approach generally pertains to header and harness connectors. The header connectors mount to printed circuit boards and have integral rigid latches at each end with latches extending upward from the base of the header, latching to the harness when the header and the harness are mated. Typically, the retention force of mated connectors with engaged rigid latches of the present approach provide about twice the retention force of unlatched mated connectors.

In another embodiment the latched harnesses are secure from accidental release or damage along their length with protective columns.

In an additional embodiment the headers have rigid integral latches molded from polymeric material that can withstand high temperatures in a reflow process.

In a further embodiment, the harness connectors with the rigid latches of the present approach engaged during connection are intended to be easily accessible by an extraction tool.

Another embodiment provides a polarization connection between the header connector and a printed circuit board to assure proper alignment during connection.

An additional embodiment provides a polarization connection to assure proper alignment between the header connector and the harness connector during connection.

DETAILED DESCRIPTION OF THE INVENTION

As required, detailed embodiments of the present approach are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner, including employing various features disclosed herein in combinations that might not be explicitly disclosed herein.

Figure 1:
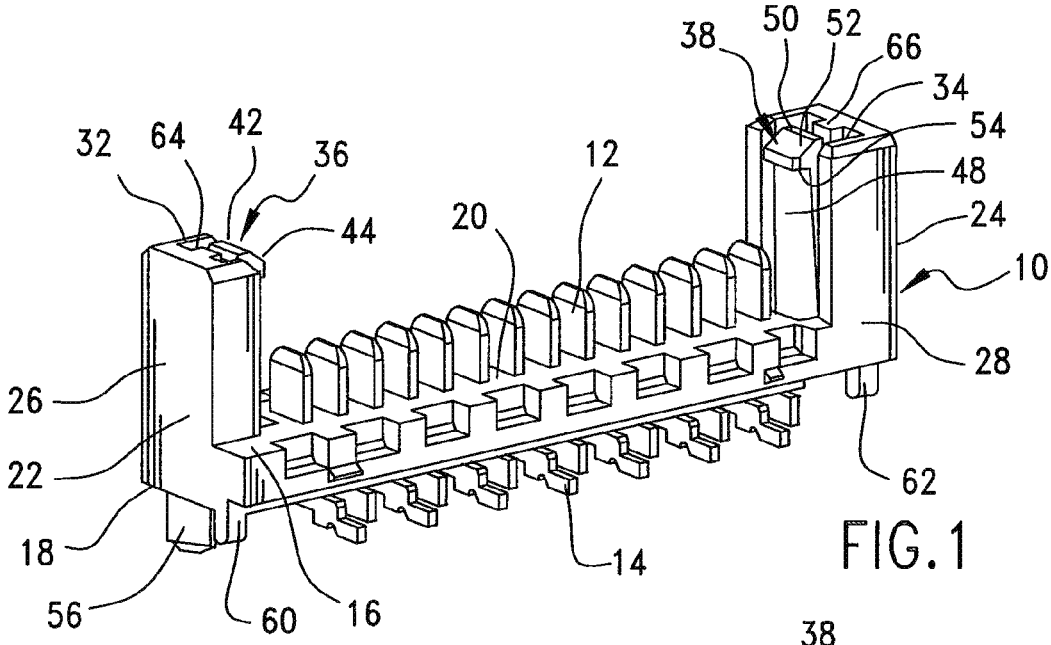
FIG. 1 is a perspective front view of a connector according to the present approach.

In an embodiment of this approach as shown in FIG. 1, a header connector, generally shown as 10, has a plurality of male contacts 12 for mating with a receptacle connector such as a harness and a plurality of mounting pins 14 for mounting to a printed circuit board. The number of male contacts is, for example, suitable for between about 2 circuits and about 36 circuits and typically between about 4 circuits and about 26 circuits. The electrical current may be AC or DC, but is typically DC. The male contacts, for example, can have a pitch of between about 1.00 mm and about 1.50 mm and typically between about 1.25 mm and about 1.30 mm. The voltage can suitably be, for instance, between about 100 volts and about 300 volts and typically between about 235 volts and about 265 volts. The current can be, for example, between about 0.5 amps and about 2.0 amps and typically between about 1.0 amp and about 1.5 amps.

Pins 14 depicted in FIG. 1 are surface mount pins suitable for solder mounting to a printed circuit board (PCB), but other pin types are suitable such as standard pins, kinked printed circuit tails, surface mount component (SMC) high temperature pins and integrated device technology (IDT) board-in pins. Male contacts 12 with accompanying mounting pins 14 are affixed in dielectric housing 16. Housing 16 has an interconnecting portion including a first surface 18, considered a PCB contact surface, and a second surface 20, considered a receptacle or harness contact surface. Housing 16 has a first end 22, considered a left end, and a second end 24, which can be considered a right end. First or left end 22 has a first column 26, which can be considered a left column, and the second or right end 24 has a second column 28, which can be considered a right column.

Figure 6:
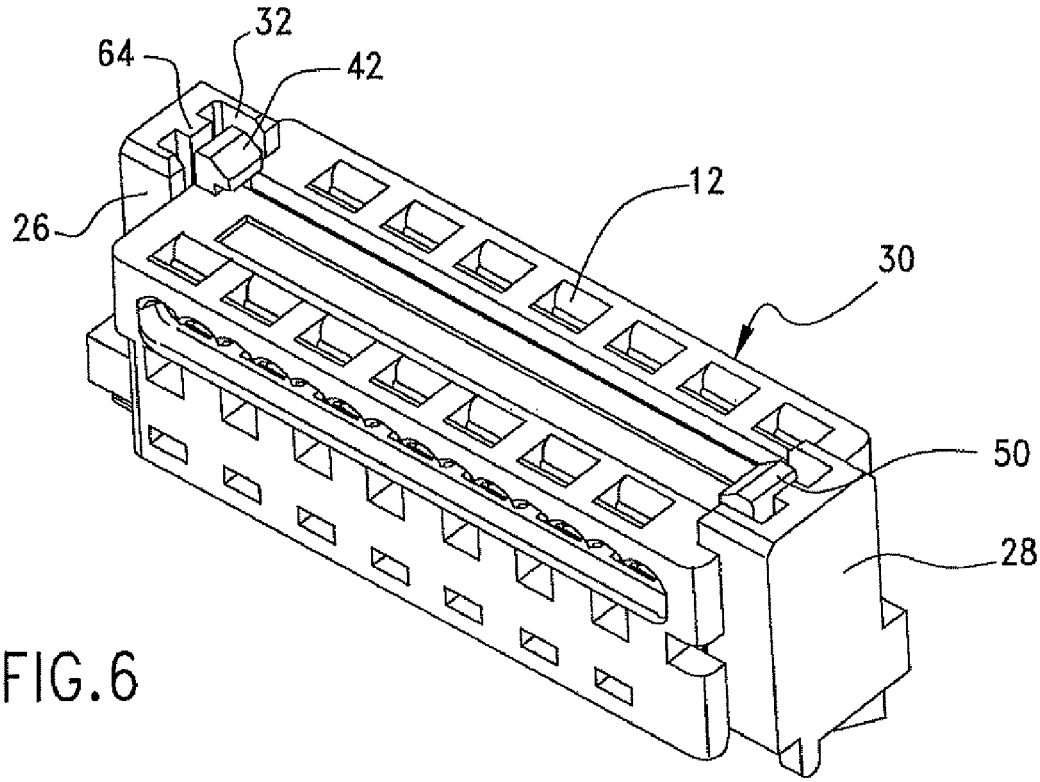
FIG. 6 is a detailed perspective view of the header connector portion shown in FIG. 5, with a harness mounted thereonto.
Figure 6A:
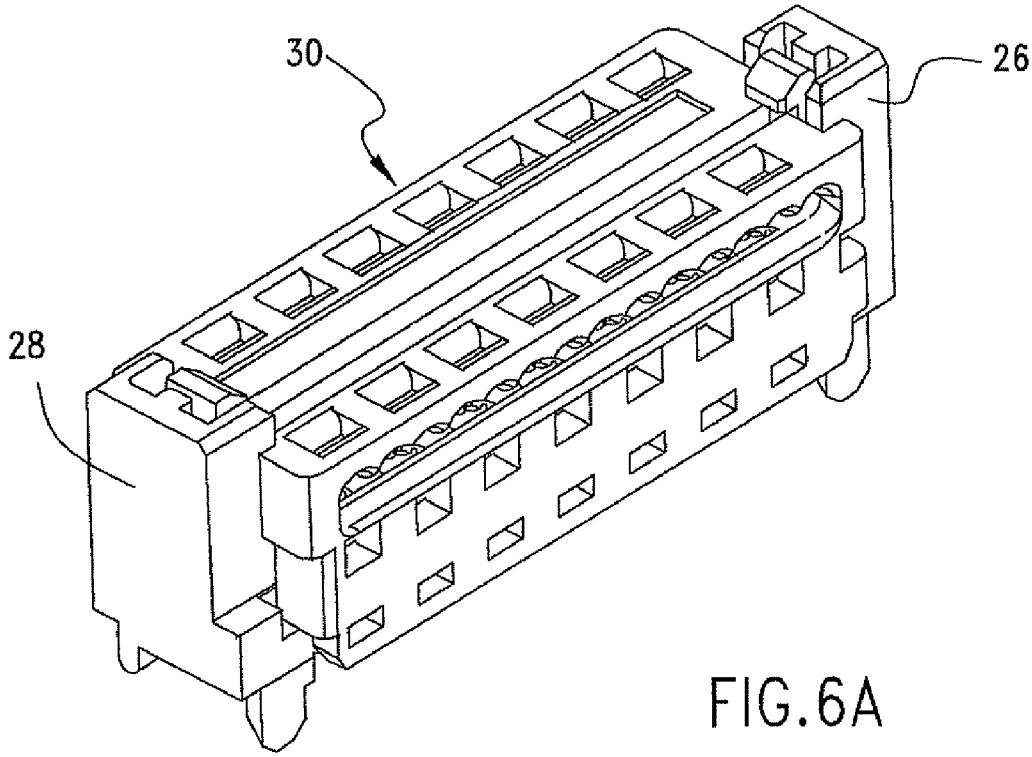
FIG. 6A is a further perspective view of a header connector portion with mounted harness from a perspective different from FIG. 6.
Figure 6B:
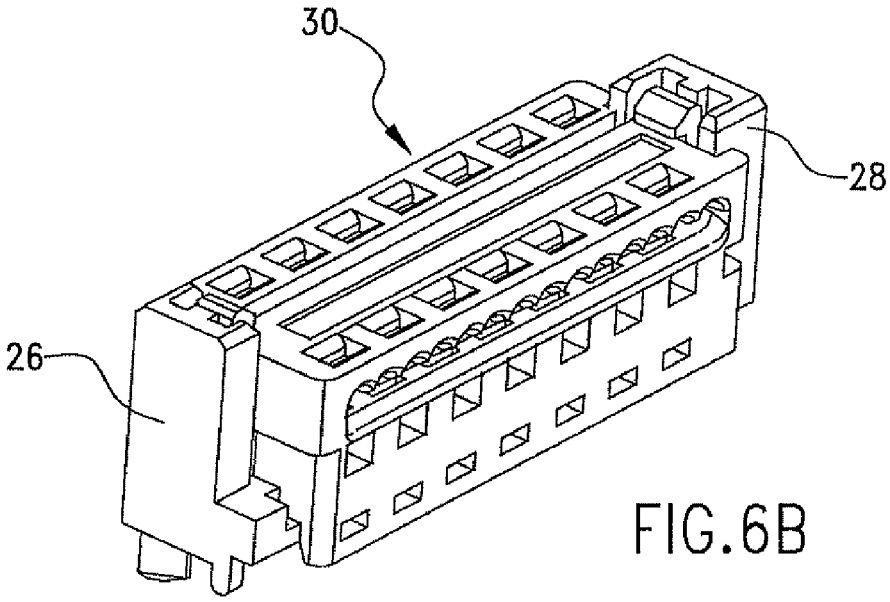
FIG. 6B is a further perspective of a header connector portion with mounted harness from a further perspective different from FIG. 6.
Figure 7:
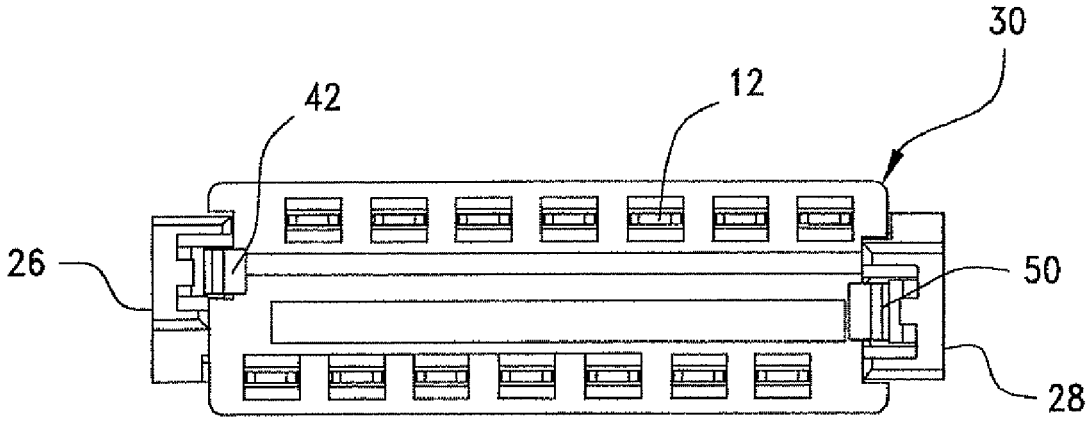
FIG. 7 is a top plan view of the header connector with harness mounted thereonto.
Figure 7A:
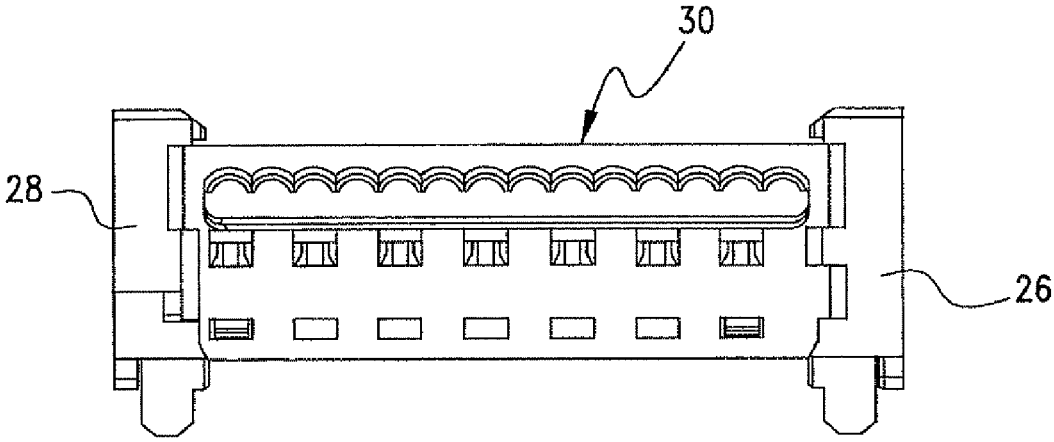
FIG. 7A is a side elevational view of the header connector with harness mounted thereonto.

Both first or left column 26 and second or right column 28 extend from harness surface 20 in a direction that can be considered upward. As viewed in FIG. 3, first or left column 26 has a height (H1) and a width (W1), and the second or right column 28 has a height (H2) and a width (W2). H1 and H2 are, for instance, between about 5.0 mm and about 7.0 mm and typically between about 6.2 mm and about 6.6 mm. H1 and H2 provide for low profile mating height configurations in a direction considered vertical. W1 and W2 are, for example, between about 3.0 mm and about 6.0 mm and typically between about 4.0 mm and 5.0 mm. W1 and W2 are suitably unequal to provide for polarized or properly aligned attachment of a receptacle connector such as a harness 30 as shown in FIG. 6, FIG. 6A and FIG. 6B, as well as in FIG. 7 and FIG. 7A.

First or left column 26 has a first elongated column cavity 32, which can be considered a left column cavity, and the second or right column 28 has a second elongated column cavity 34, which can be considered a right column cavity. Within the first or left column cavity 32 and second or right column cavity 34 are a first latching mechanism, generally shown as 36, and that can be considered a left latching mechanism, and right latching mechanism, generally shown as 38, and that can be considered a right latching mechanism, respectively. First or left latching mechanism 36 is comprised of a first beam 40, that can be considered a left beam, and same extends from harness surface 20 in a direction that can be considered upward, and further comprised of a first latching end 42, that can be considered a left latching end and terminal to first or left beam 40.

Figure 2:
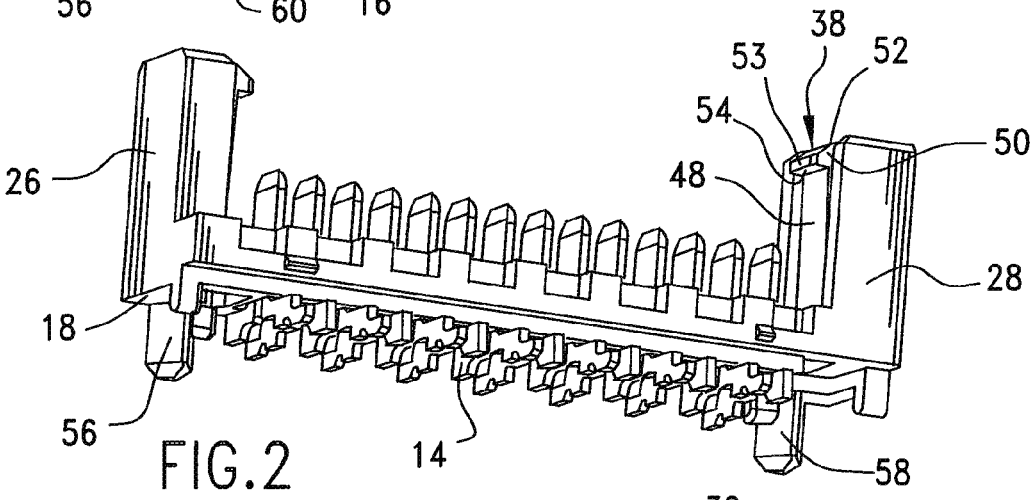
FIG. 2 is another perspective front view of the connector shown in FIG. 1.
Figure 3:
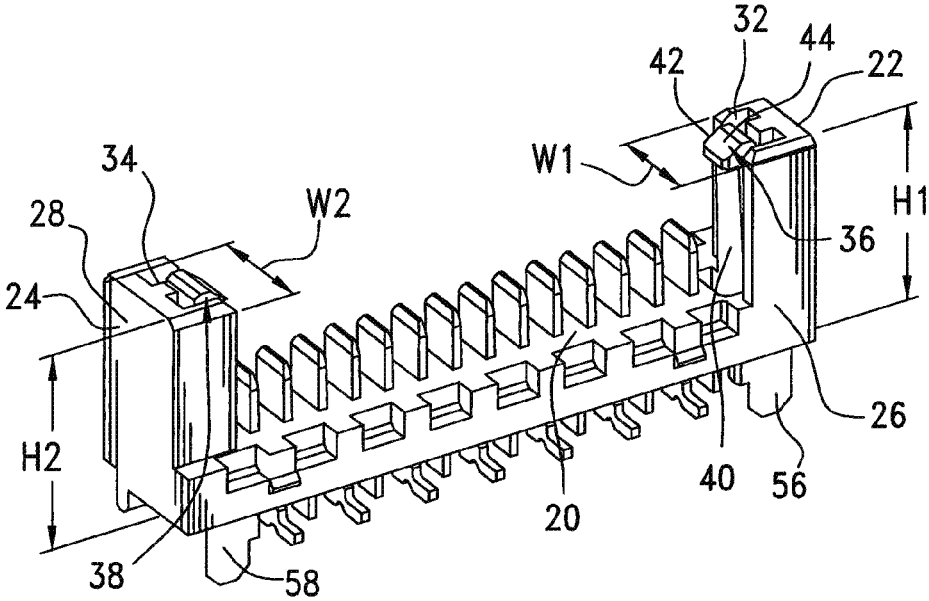
FIG. 3 is a perspective rear view of the connector that is shown in FIG. 1.
Figure 4:
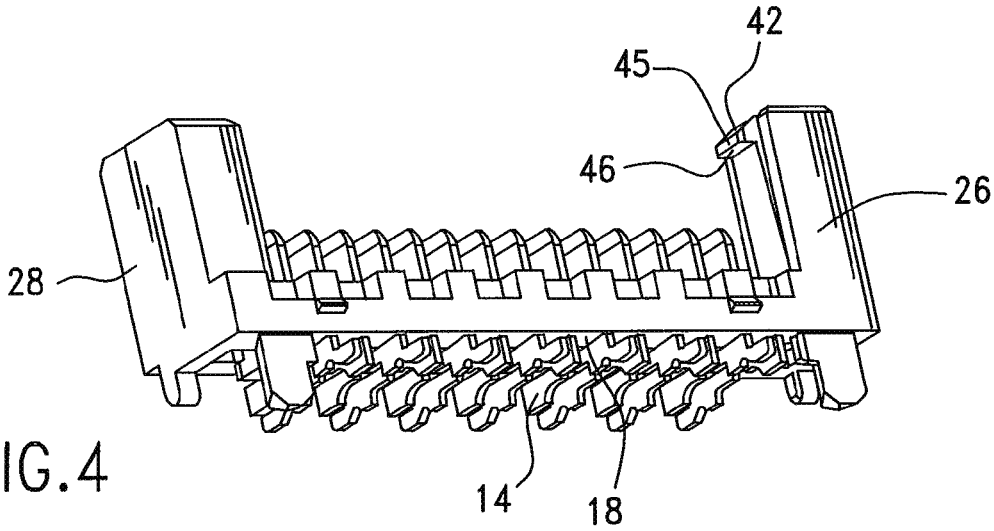
FIG. 4 is another perspective rear view of the connector that is shown in FIG. 1.
Figure 5:
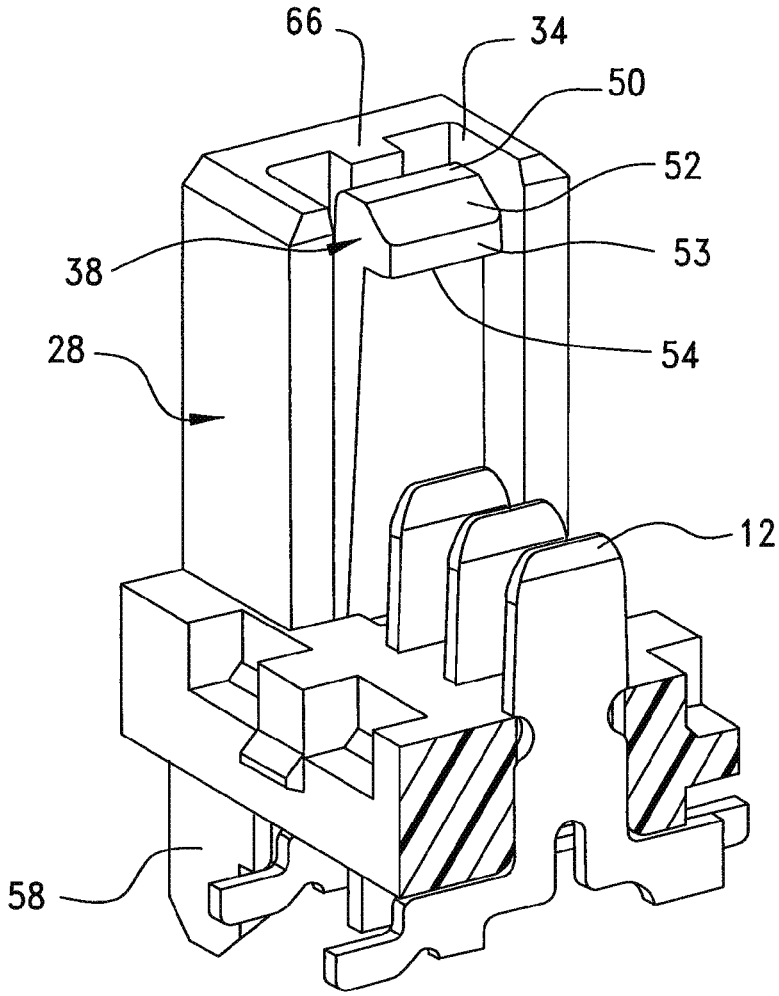
FIG. 5 is a detailed perspective view, in cross-section, of a portion of the header connector of FIG. 1, showing a latch mechanism.

As viewed in FIGS. 3 and 4, the first or left latching end 42 includes a first camming surface 44, which can be considered a left camming surface, a first latch wall 45, which can be considered a left latch wall, and a first retention surface 46, which can be considered a bottom left retention surface. As viewed in FIG. 2 and FIG. 5, the second or right latching mechanism 38 is comprised of a second beam 48, which can be considered a right beam, and same extends from harness surface 20 in a direction that can be considered upward, and further comprised of a second latching end 50, that can be considered a right latching end and terminal to second or right beam 48. The second or right latching end 50 includes a second camming surface 52, which can be considered a right camming surface, a second latch wall 53, which can be considered a right latch wall, and a second retention surface 54, which can be considered a right bottom retention surface. The first latch wall extends between the lower portion of the first camming surface and the first retention surface while the second latch wall extends between the lower portion of the second camming surface and the second retention surface as seen in FIGS. 1-5.

First or left column 26 and second or right column 28 surround first or left latch mechanism 36 and a second or right latch mechanism 38 respectively to protect the latch mechanisms from damage and accidental release of latch ends 42 and 50. The first or left column 26 also has a first elongated projection 64 that can be considered a left elongated projection that is in proximity to the first or left latching mechanism 36 providing overstress protection. The second or right column 28 has a second elongated projection 66 that can be considered a right elongated projection that is in proximity to second or right latching mechanism 38 providing overstress protection. Extending from circuit board contact surface 18 in a direction considered downward are polarizing guides 56 and 58 and centering projections 60 and 62 to aid in mounting header 10 to a circuit board at a proper orientation.

Housing 16 suitably can be prepared, for example, from polymeric materials that can withstand temperatures between about 250° C. and about 270° C., typically between about 255° C. and 265° C., in a reflow process while having a melt temperature, for instance between about 310° C. and 330° C., typically between 315° C. and 325° C. Suitable materials include polyphthalamide plastics ("PPA polymers") such as PA6T/66 material types as designated in ASTM D5336.

Figure 9:
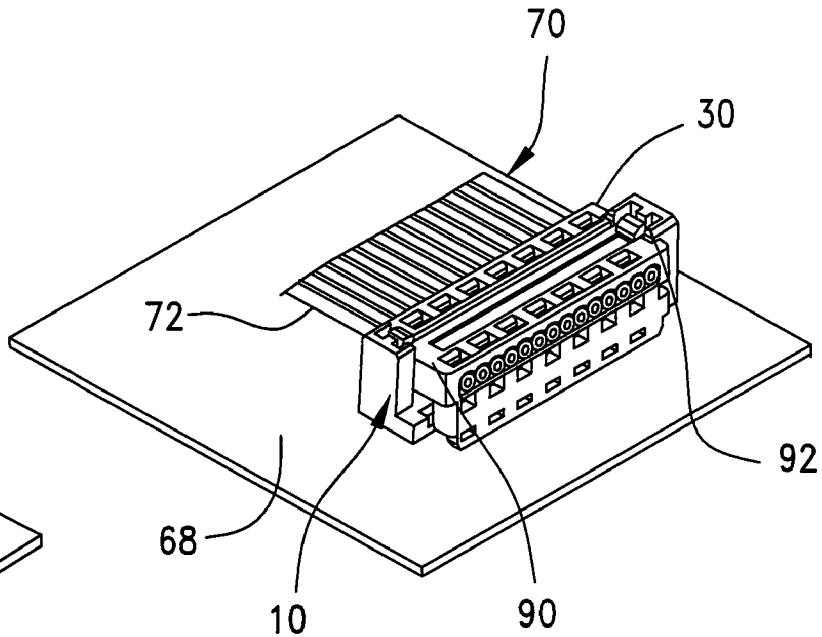
FIG. 9 is a perspective view of the receptacle connector mated and latched with the mounted connector shown in FIG. 8.
Figure 8:
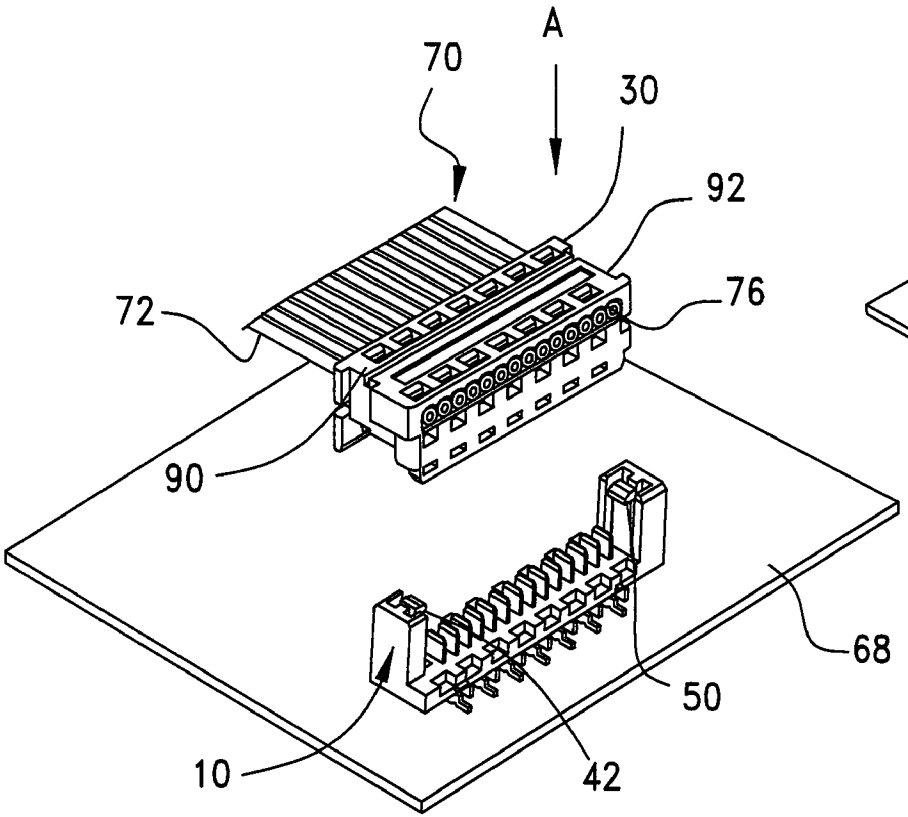
FIG. 8 is a perspective view of a receptacle connector assembly positioned above and disconnected from a board mounted connector according to the present approach.
Figure 10:
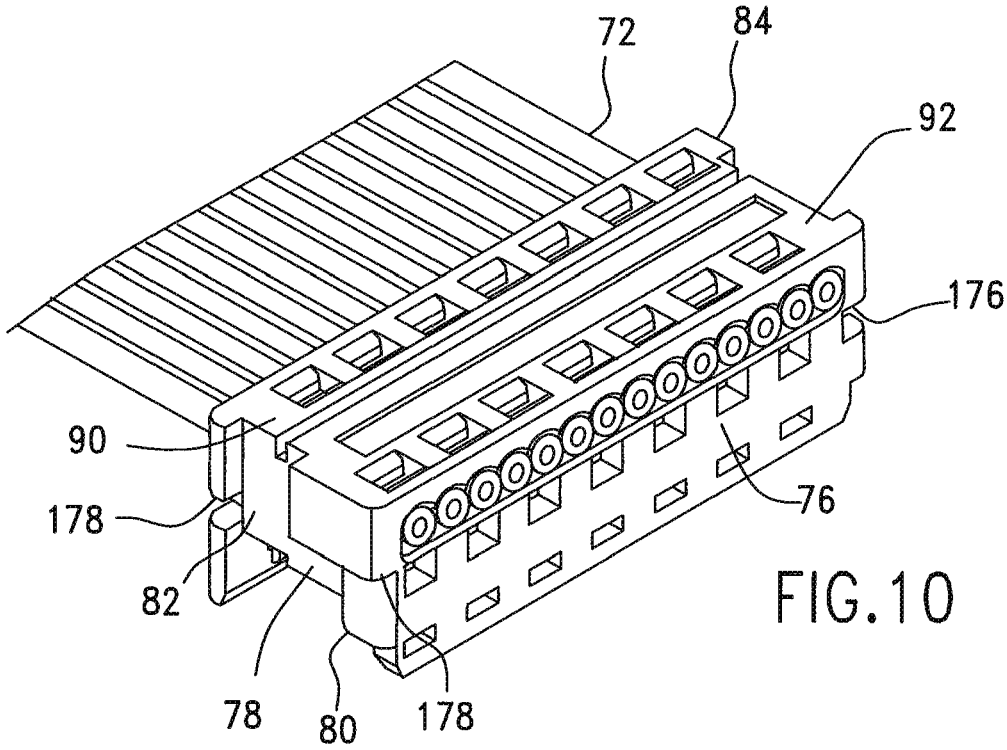
FIG. 10 is an enlarged perspective view of the receptacle connector shown in FIG. 8.
Figure 11:
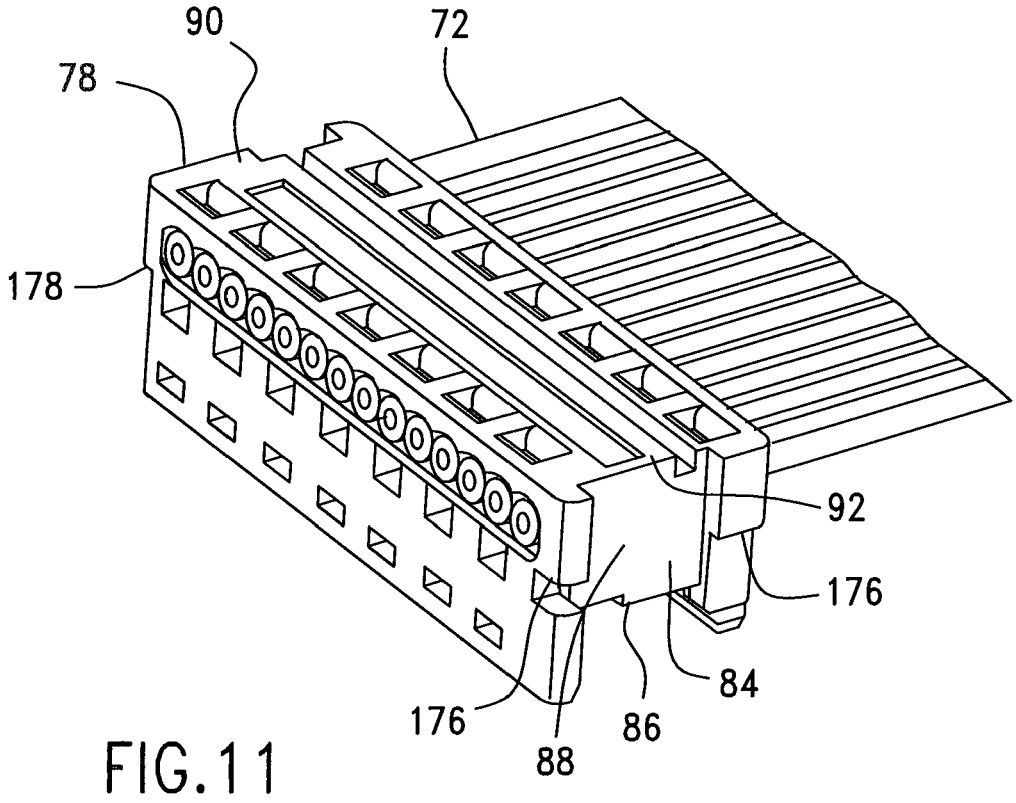
FIG. 11 is another enlarged perspective view of the receptacle connector shown in FIG. 8.

Header 10 is shown in FIGS. 8 and 9 mounted to a printed circuit board 68. Cable assembly, generally shown as 70, is comprised of ribbon cable 72 and a receptacle connector, suitably a harness 30 that comprises a harness housing 76 with a plurality of receptacle contacts corresponding to and matable with male contacts 12 of connector 10. Harness housing 76, as illustrated in FIGS. 10 and 11, has a first cavity 78 that can be considered a left side cavity with a first latch engaging edge 80, which can be considered a bottom left latch engagement ledge, and with a first harness wall 82 that can be considered a left harness wall. Harness housing 76 also has a second cavity 84 considered a right side cavity with a second latch engaging edge 86, which can be considered a bottom right latch engagement ledge, and with a second harness wall 88 that can be considered a right harness wall. Furthermore, harness housing 76 has a first retention surface 90 that can be considered a top left retention surface and a second retention surface 92 that can be considered a top right retention surface. The plurality of receptacle contacts are carried intermediate the first cavity 78 and the second cavity 84.

As harness 30 mates with header 10, first or left column 26 and second or right column 28 of header 10 are positioned within first or left cavity 78 and second or right cavity 84 of harness 30, respectively. Harness 30 moves to the header 10 in a direction A shown in FIG. 8 wherein bottom first or left edge 80 and bottom second or right edge 86, as shown in FIGS. 10 and 11, first engage left camming surface 44 and right camming surface 52 as depicted in FIG. 1, respectively. This engagement urges first or left latch end 42 and second or right latch end 50 to spread apart by moving outwardly away from each other. Further movement of harness 30 in direction A results in the engagement and then disengagement of first or left latch wall 45 (see FIG. 4) and second or right latch wall 53 (see FIG. 2) with first or left harness wall 82 (see FIG. 10) and second or right harness wall 88 (see FIG. 11). Upon disengagement first or left bottom retention surface 46 (see FIG. 9) and second or right bottom retention surface 54, as shown in FIG. 2, snap inwardly towards each other and engage top left retention surface 90 and top right retention surface 92 as depicted in FIG. 8, respectively, thus latch locking harness 30 in mating relationship with header 10. Header 10 and harness 30 when mated and latch locked are intended to exhibit relatively high retention forces. Achievable retention forces can be, for instance, between about 35 N and about 50 N for a four circuit sized connector and between about 140 N and 180 N for a twenty-six circuit sized connector, for example.

Latched harness 30 is easily accessible to an extraction tool (not shown) in order to facilitate disconnection. Typically, a tool can be used in order to overcome the retention force of the connector and extract latched harness 30 from header 10. First ledges 176, which can be considered right ledges, of harness 30 (shown in FIG. 11) and second ledges 178, which can be considered left ledges, of harness 30 (depicted in FIG. 10) are adapted to be easily accessible to a suitable extraction tool (not shown). First ledges 176 and second ledges 178 can be gripped by the extraction tool such that harness 30 can be removed from header 10 by applying a force to the extraction tool that applies an unmating force to harness 30 in a direction considered upward as viewed in FIGS. 8 through 11 and that is sufficient to overcome the retention force between harness 30 and header 10. Also a component or components of the tool can engage right latch end 50 urging the right latch end outwardly and to disengage from the harness 30, while the left latch end 42 can be engaged by a tool component urging the left latch end outwardly to also disengage from the harness 30. These features of the header facilitate removal action of this type by a suitable tool.

It will be understood that there are numerous modifications of the illustrated embodiments described above which will be readily apparent to one skilled in the art, such as many variations and modifications of the miniature receptacle terminals and/or its components including combinations of features disclosed herein that are individually disclosed or claimed herein, explicitly including additional combinations of such features, or alternatively other types of miniature receptacle terminals. Also, there are many possible variations in the materials and configurations. These modifications and/or combinations fall within the art to which this approach relates and are intended to be within the scope of the claims, which follow.

What is claimed is:

1. A board-mounted connector comprising:

a dielectric housing constructed from a polymeric material, said dielectric housing comprising:

a. a first column having a first elongated column cavity therein;

b. a first latching mechanism at least partially within said first column cavity, said first latching mechanism comprised of a first latch beam and a first latching end;

c. a second column having a second elongated column cavity therein; and d. a second latching mechanism at least partially within said second column cavity, said second latching mechanism comprised of a second latch beam and a second latching end;

e. an interconnecting portion extending between said first column and said second column; and a plurality of male contacts with board mounting pins carried by said interconnecting portion of said dielectric housing; and B. a cable ribbon connector comprising:

a cable ribbon housing comprising:

a. a first cavity for receiving the first column of the board mount connector; and b. a second cavity for receiving the second column of the board mount connector; and a plurality of receptacle contacts carried intermediate said first cavity and said second cavity corresponding to and respectively engageable with the male contacts of the board mount connector.

2. The board-mounted connector according to claim 1, wherein the first column includes a first elongated projection in proximity to the first latching mechanism providing overstress protection, and the second column includes a second elongated projection in proximity to the second latching mechanism providing overstress protection.

3. The board-mounted connector according to claim 1, wherein said interconnecting portion of said housing includes a printed circuit board (PCB) contact surface on one side and a harness contact surface on an opposite side, said PCB contact surface having polarized guides extending therefrom to facilitate proper orientation with respect to a circuit board to which said connector will be connected.

4. The board-mounted connector according to claim 1, wherein the male and receptacle contacts have a pitch of between about 1.00 mm and about 1.50 mm.

5. The board-mounted connector according to claim 1, wherein the first column and the second column each have a height between about 5.0 mm and about 7.0 mm.

6. The board-mounted connector according to claim 1, wherein the first column and the second column each have a width between about 3.0 mm and about 6.0 mm.

7. The board-mounted connector assembly according to claim 1, wherein:

the first latching end of the board mount connector includes a first camming surface, a first latch wall and a first retention surface and the second latching end of the board mount connector includes a second camming surface, a second latch wall and a second retention surface: and the first cavity of the cable ribbon connector includes a first latch engaging edge, a first connector wall and a first retention surface and the second cavity of the cable ribbon connector includes a second latch engaging edge, a second connector wall and a second retention surface, wherein during mating of said cable ribbon connector with said dielectric housing, said first latch engaging edge engages said first camming surface and said second latch engaging edge engages said second camming surface to spread apart said first latching end from said second latching end.

8. The board-mounted connector assembly according to claim 1, wherein the polymeric material has been prepared in a high temperature reflow process and can withstand temperatures between about 250° C. and about 270° C. in a reflow process.

* * * * *